US005618204A

United States Patent [19]

Nix et al.

[11] Patent Number: 5,618,204

[45] Date of Patent: Apr. 8, 1997

[54] CIRCULAR BULKHEAD CONNECTOR ASSEMBLY

[75] Inventors: Lothar H. W. Nix, Mörfelden-Walldorf; Lothar A. Post, Offenbach, both of Germany

[73] Assignee: The Whitaker Corporation, Wilmington, Del.

[21] Appl. No.: 258,648

[22] Filed: Jun. 13, 1994

[30] Foreign Application Priority Data

Aug. 13, 1993 [GB] United Kingdom ..... 9316838

[51] Int. Cl.[6] ..... H01R 13/54

[52] U.S. Cl. ..... 439/559; 439/271; 439/551

[58] Field of Search ..... 439/551, 559, 439/271, 556, 550

[56] References Cited

U.S. PATENT DOCUMENTS

| | | | |
|---|---|---|---|
| 2,666,804 | 1/1954 | Gross | 439/271 X |
| 2,666,805 | 1/1954 | Smith | 439/271 X |
| 2,672,500 | 3/1954 | Bondon | 439/271 X |
| 3,719,918 | 3/1973 | Kerr | 439/559 X |
| 4,179,179 | 12/1979 | London | 439/559 |
| 4,405,196 | 9/1983 | Fulton | 439/551 |
| 4,573,757 | 3/1986 | Cochran et al. | 439/271 |
| 4,653,835 | 3/1987 | Schulte et al. | 439/556 |
| 4,676,575 | 6/1987 | Denlinger et al. | 439/559 X |
| 4,702,710 | 10/1987 | Dittman et al. | 439/271 |
| 4,773,871 | 9/1988 | Behning | 439/551 |
| 4,973,147 | 11/1990 | Fujita et al. | 350/637 |

FOREIGN PATENT DOCUMENTS

| | | | |
|---|---|---|---|
| 0446466A1 | 9/1991 | European Pat. Off. . | |
| 1333168 | 6/1963 | France | 439/550 |
| 8911625 | 2/1990 | Germany . | |
| 619104 | 3/1961 | Italy | 439/559 |
| 878221 | 9/1961 | United Kingdom | 439/556 |
| 881956 | 11/1961 | United Kingdom | 439/559 |
| 2208338 | 3/1989 | United Kingdom | 439/271 |

*Primary Examiner*—William Briggs
*Attorney, Agent, or Firm*—Driscoll A. Nina

[57] ABSTRACT

A panel mount connector comprises a panel mount component and a movable component. The panel mount connector can be mounted to a panel by a combined sealing and provisional mounting ring. The movable connector part comprises a terminal receiving housing and a bayonet type rotatable locking ring having a first axial position allowing mounting of a rubber boot to the housing, the locking ring retractable to a second position partially extending over the rubber boot in order to prevent it from being accidentally pulled off the housing. The connectors can then be mated together by aligning keying means of the housing with corresponding keying means of the panel connector housing, axially moving the housings together, and then rotating the bayonet type locking ring until an end position whereby the sealing ring is compressed between a flange of the locking ring and the panel for sealing therebetween.

8 Claims, 10 Drawing Sheets

CIRCULAR BULKHEAD CONNECTOR ASSEMBLY

BACKGROUND OF THE INVENTION

1. Field of the Invention

This invention relates to a circular connector mountable to a bulkhead or panel and comprising sealing means.

2. Summary of the Prior Art

It is common to find circular electrical connectors for use in the automobile industry whereby the connector is mounted to a panel of the body work and electrically connects cables, for example in the engine compartment to cables in the passenger compartment. In order to prevent dust and liquid ingress into the electrical connector and into the passenger compartment, the circular bulkhead connectors commonly comprise sealing means such as a flexible rubber boot that is mounted around the connector and cables on the engine compartment side. Examples of such bulkhead connectors are shown in German patent application P 4306806.5 and Great Britain patent application 9204894.1. In order to facilitate assembly, one of the connector parts is usually mountable to the bulkhead and the other connector part can be mated therewith at an ulterior stage in the assembly procedure. One of the preferred connection mechanisms for coupling circular connectors is a bayonet type of mechanism, whereby one connector part is rotated relative to the other as the mating terminals are pushed together. For assembly reasons, the panel mounted connector part is usually the part found on the passenger compartment side, which doesn't require any sealing means. The other connector part comprising the rubber boot and sealing means is then connected thereto.

One of the problems associated with the above, is that during assembly of the mating connector parts, the rubber boot is often pulled off as it has to be held during rotation of the connector. As the latter happens on the assembly line of the automobile, it is time consuming and therefore costly to refit the rubber boot in its correct position. Further, a disadvantage of the above connectors is that the male terminals belonging to the engine compartment connector part protrude from a mating face thereof, unprotected and thus prone to damage. Yet another disadvantage of the above connectors, is that the passenger compartment connector part is mounted to a panel with resilient latches, whereby the connector part is time consuming and sometimes very difficult to remove from the panel, and the latches are prone to damage by the sharp edges of the panel hole.

It would therefore be desirable to produce a circular bulkhead connector that has securely mounted sealing means, provides protection for the terminals and is easily mountable and dismountable from a panel. As the terminals passing through a panel of an automobile often stem from many differently located devices, and the cost of modifying or adding many holes to the panel is high, it is also desirable to provide a connector that can accommodate different terminal modules for electrical, optical, or pneumatic connection all within the same connector body. The latter would mean that later improvements or modifications to the automobile do not require changing the panel stamping and forming dies but only the connector. Additionally, the connections could be made through a panel by only one connector comprising a variety of terminal modules therein instead of individually connecting and sealing the individual terminal modules across the panel, which simplifies and quickens the assembly procedure thereof.

SUMMARY OF THE INVENTION

It is therefore an object of this invention to provide a connector for mounting to a panel that is easily mountable and dismountable therefrom yet providing reliable sealing means.

It is another object of this invention to provide a connector to which rubber boot sealing means can be easily mounted but securely and reliably held thereon.

It is a further object of this invention to provide a connector whereby terminals can be assembled thereto in a rapid, reliable and secure manner without possibility of error during mounting thereof.

An object of this invention has been achieved by providing a panel mount connector comprising a first connector part mountable to a panel and a second connector part matable to the first part characterized in that the connector comprises a sealing ring mountable to the first connector part from one side of the panel when the first connector part is inserted to a hole in the panel from the other side thereof, whereby the sealing ring provisionally holds the first connector part to the panel prior to mating with the second connector part, and whereby the sealing ring acts as a seal between one side and the other side of the panel when the first and second connector parts are mated together.

Another object of this invention has been achieved by providing a panel mount connector characterized in that the second connector part comprises a housing for receiving electrical, optical, or pneumatic terminals and a rotatable locking ring for securing the second to the first connector part, the housing comprising rubber boot fixing means around the periphery thereof proximate a terminal receiving end, and the locking ring comprising a shroud whereby the locking ring is slidable from a first position away from the rubber boot fixing means to a second position proximate the means such that the shroud extends at least partially thereover for preventing removal of the rubber boot therefrom.

Yet another object of this invention has been achieved by providing a panel mount connector whereby the first connector part comprises compartments for slidably receiving distinct modules having terminals mounted therein, the terminal modules securely fixable within the compartments.

DETAILED DESCRIPTION OF THE PREFERRED EMBODIMENT

Figure 1:
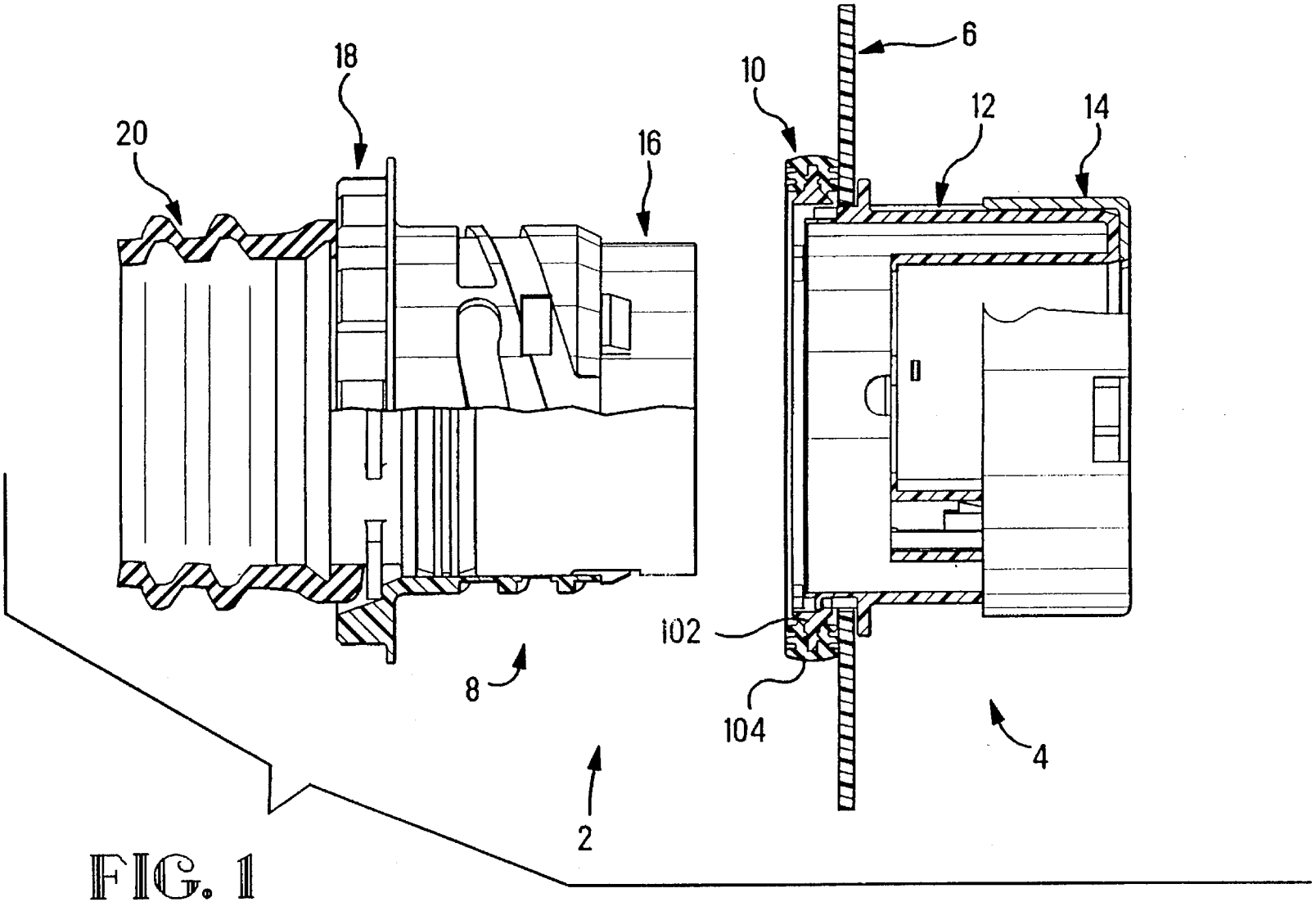
FIG. 1 is a cross sectional view of a circular bulkhead connector assembly about to be mated together.
Figure 3:
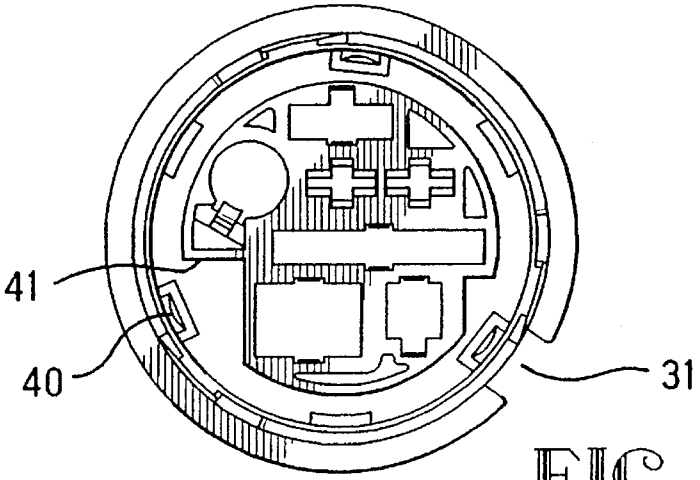
FIGS. 2 to 5 are respectively top, bottom, cross sectional and side views of a panel mount component of the connector of FIG. 1.
Figure 5:
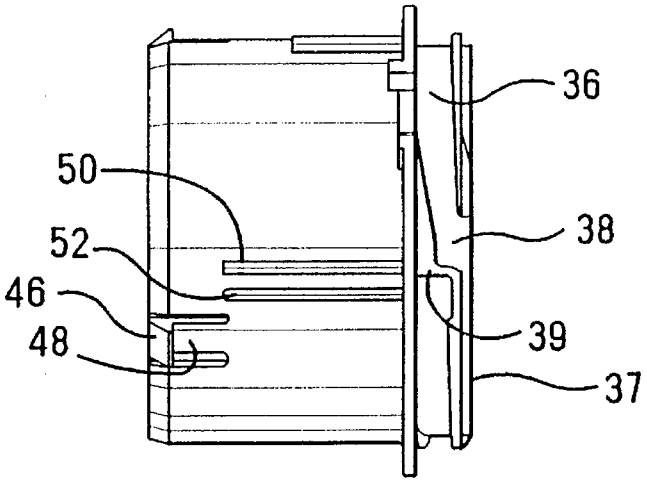
Figure 2:
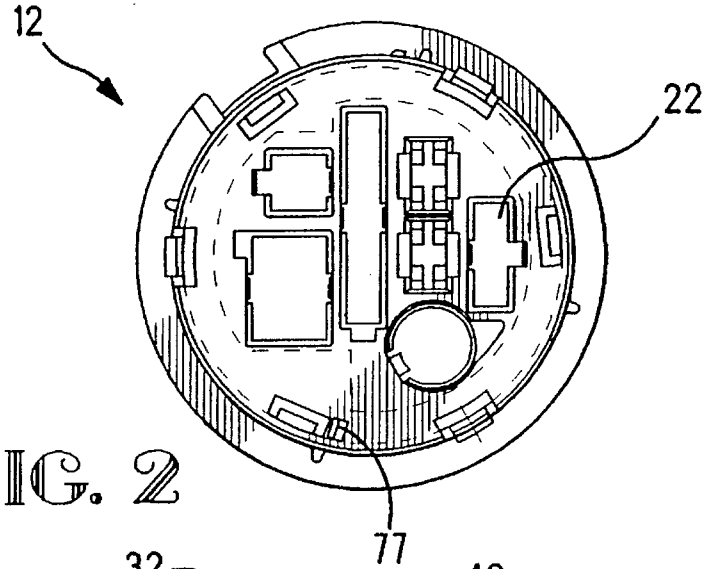
Figure 4:
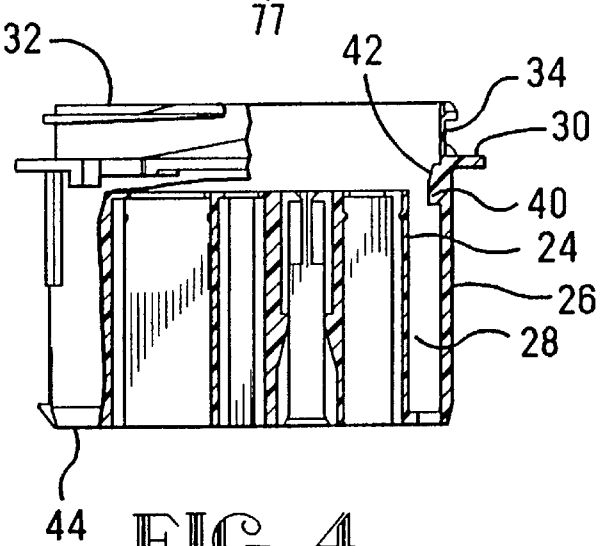
Figure 7:
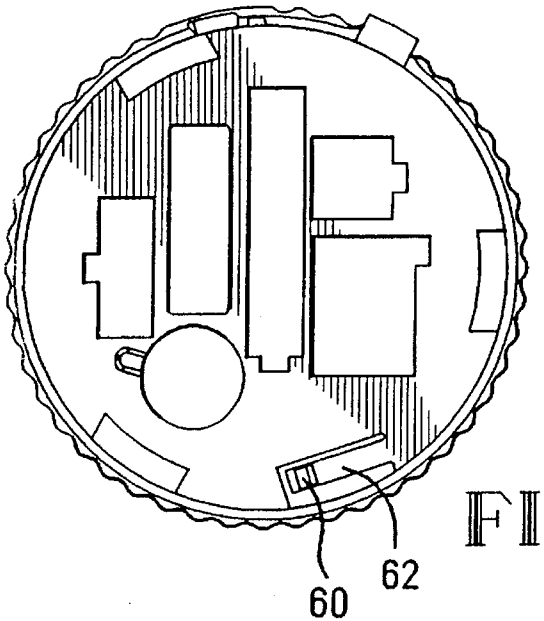
FIGS. 6 to 10 are respectively top, bottom, side and detail views of a terminal retention end cap that fits over the component of FIGS. 2 to 5.
Figure 10:
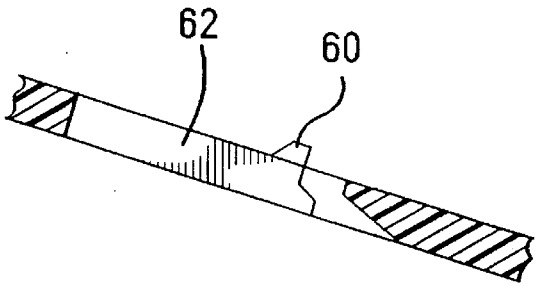
Figure 9:
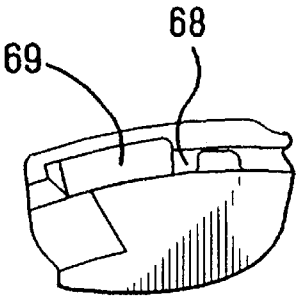
Figure 6:
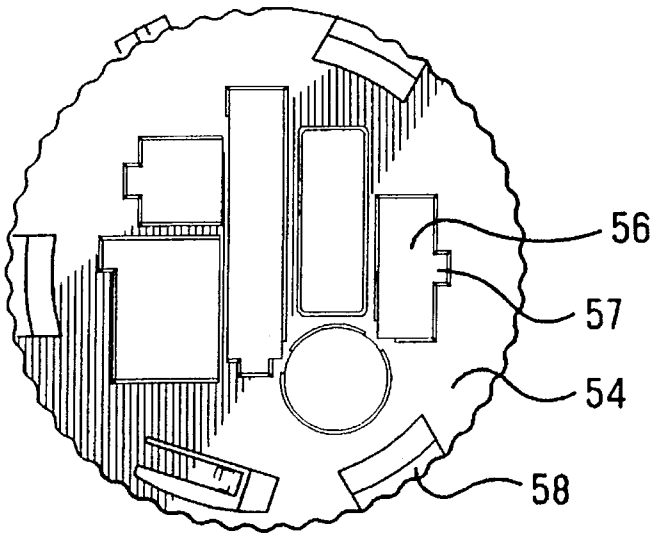
Figure 8:
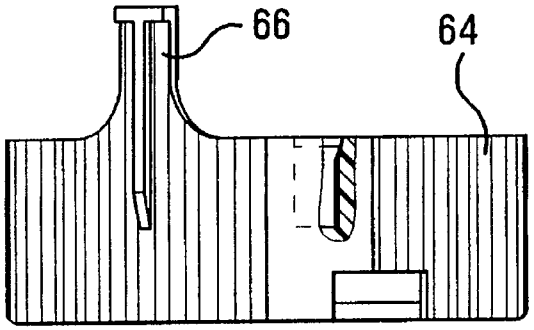

Referring to FIG. 1 a circular bulkhead connector 2 comprises a panel mount connector 4 mounted to a panel 6, and a movable connector 8. The panel mount connector 4 comprises a sealing and provisional mounting ring 10, a terminal module receiving housing 12 and a terminal module retention cap 14. The movable connector 8 comprises a terminal receiving housing 16, a locking ring 18 rotatably mounted thereon and a rubber boot 20.

The panel mount connector 4 will now be described in more detail. Referring to FIGS. 2 to 5, the terminal module receiving housing 12 is shown comprising a plurality of distinct terminal module receiving cavities 22, encompassed by an inner shell 24 and an outer shell 26 spaced therefrom by a mating connector shroud receiving cavity 28. The housing 12 further comprises a flange 30 proximate a mating end 32, the flange 30 having a polarizing gap 31, and extending therefrom towards the mating side 32 is a shroud 34 having three helicoidal grooves 36 for receiving the mounting and sealing ring 10. The grooves 36 have slots 38 on a mating side 32 thereof for enabling tabs of the ring 10 to enter thereinto, and separating the entry slots 38 and the ends of the helicoidal grooves 36 is a wall 39. On the inside of the outer shell 26, proximate the mating side 32, are cylindrical locking studs 40 having a tapered leading surface 42 for engagement in the grooves 119 of the locking ring 18. On the outside of the outer shell 26 proximate a terminal receiving end 44, are end cap mounting projections 46 protruding outwardly of the shell 26 and attached to resilient arms 48. Also on the cylindrical outer shell 26 are a pair of spaced apart protrusions 50, 52 cooperable with protrusions on the end cap 14.

With reference to FIGS. 6 to 10, the end cap 14 will now be described in detail. The end cap 14 comprises an end wall 54 having terminal module receiving holes 56, housing latch receiving holes 58 cooperable with the latches 46, and a locking protrusion 60 attached on a resilient arm 62. Extending from the periphery of the end wall 54, is a serrated cylindrical wall 64 having a tab portion 66 extending further therefrom towards the mating side for ensuring the locked position of the end cap to the component housing 12 before mounting to the panel 6. On the inner side of the cylindrical wall 64 is a longitudinal protrusion 68 engageable between the protrusions 50, 52 of the housing component 12, and contiguous therewith is a longitudinal trough 69 that is wide enough to span the protrusions 50, 52.

Figure 12:
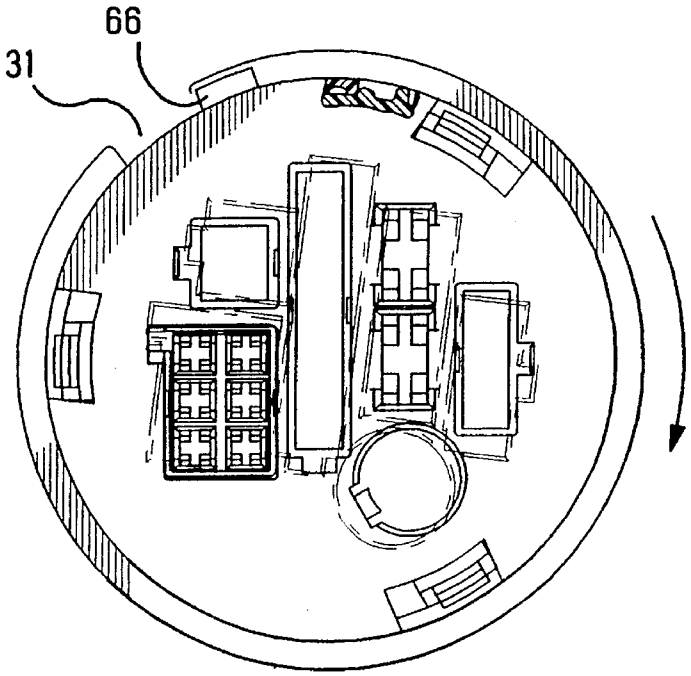
FIGS. 11 and 12 show the cap mounted on the panel component and in, respectively, a terminal module receiving position and a locked position.
Figure 11:
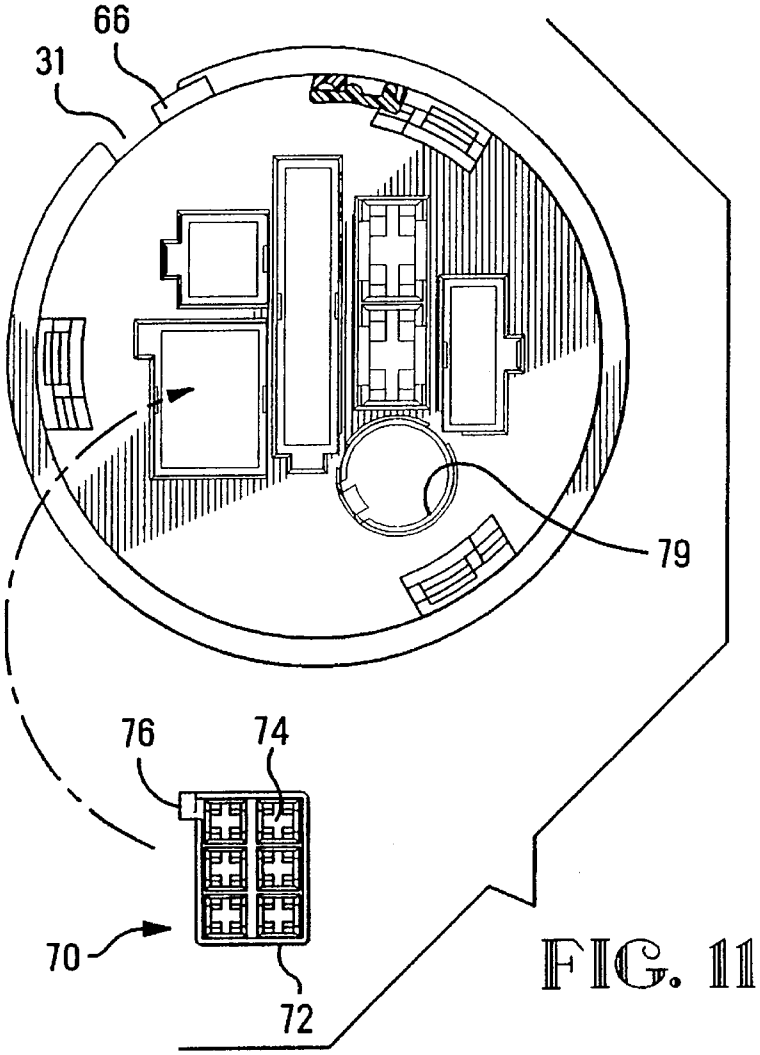

With reference to FIGS. 11 and 12, assembly of the end cap 14 to the housing component 12 and terminal modules therein, will now be explained in detail. A terminal module generally shown at 70, comprises a housing 72 having a plurality of terminal receiving cavities 74 therein, into which terminals can be inserted and securely retained as commonly found in the prior art. The terminal module 70, also comprises a polarizing projection 76. A plurality of distinct terminal modules 70 with any possible combination of terminals or types of terminals (e.g. electrical, optical) are provided for assembly into the housing component 12. A circular cavity 79 is also shown, the cavity 77 for receiving a vacuum pipe terminal (pneumatic pipe) which is used, for example, in the central locking system of an automobile. The mating pipe terminals (not shown) comprise a smaller diameter and a larger diameter pipe secured respectively to the panel and movable connectors 4, 8, whereby elastomeric "O"-ring seals provide sealing between the smaller pipe inserted into the larger pipe during connection therebetween.

The end cap 14 is first assembled to the housing 12 by inserting it over the terminal receiving face 44 thereof until the latches 48, 46 of the housing 12 engage with the cavities 58 of the end cap for secure retention thereof. During the latter, the end cap is orientated such that the holes 56 are aligned with the corresponding terminal module receiving cavities 22 and whereby the longitudinal trough 69 in the inside of the end cap wall 64 is positioned over the longitudinal protrusions 50, 52 of the housing outer wall 26. The terminal modules 70 can then be inserted into their corresponding cavities 56 whereby the polarizing protrusion 76 cooperate with polarizing grooves 57 in order to correctly orientate the terminal modules with respect thereto. Once all of the terminal modules 70 have been fully inserted into their corresponding receiving cavities 56, the end cap 14 can then be rotated by a few degrees as shown in FIG. 12 such that the holes 56 and cavities 22 are misaligned. Simultaneously to the latter, the longitudinal projection 68 on the inside of the end cap cylindrical wall 64 resiliently biases over the longitudinal projection 50 of the housing 12 and seats itself between the projections 50, 52 when the end cap is in the fully rotated end position. Also simultaneously thereto, the projection 60 (FIG. 10) engages in a corresponding cavity 79 (FIG. 2) on the terminal receiving side of the housing 12 which serves to further retain the end cap in it's fully rotated and locked position.

In the terminal receiving position, the forwardly extending tab 66 of the end cap partially overlaps the panel tab mounting gap 31 as shown in FIG. 11. When the end cap is rotated to the fully locked position, the tab 66 is rotated out of it's overlapping position with the panel tab receiving gap 31 such that the panel mount connector 4 can be mounted to the panel 6.

Figure 14:
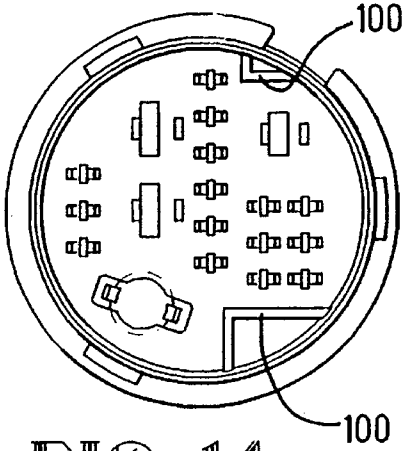
FIGS. 13 to 15 are respectively side, top and cross sectional views of a mating terminal receiving component of the embodiment of FIG. 1.
Figure 13:
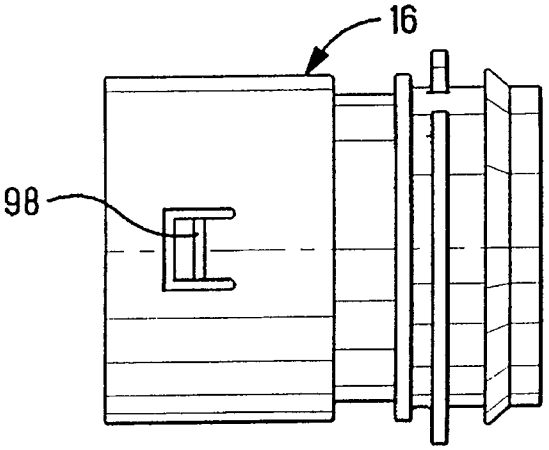
Figure 15:
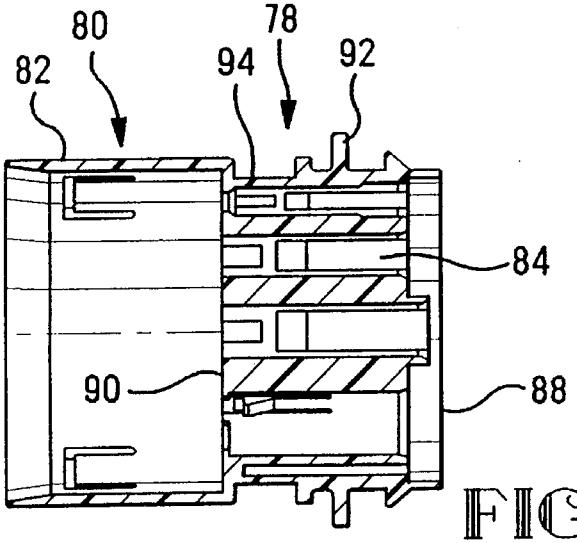
Figure 25:
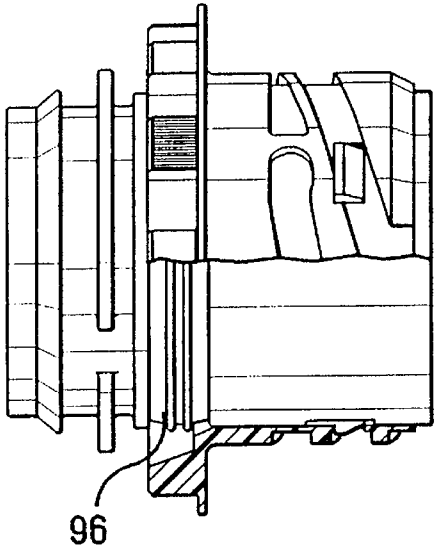

With reference to FIGS. 13 to 15, the terminal receiving housing 16 of the movable connector 8 will now be described in detail. The movable component housing 16 comprises a terminal receiving portion 78 and a mating portion 80 having a shroud 82 extending from the terminal receiving portion 78, the shroud 82 insertable into the gap 28 (FIG. 4) of the panel mount housing 12. The terminal receiving portion 78 comprises a plurality of terminal receiving cavities 84. Extending around the periphery of the terminal receiving portion 78, is a tapered rubber boot mounting flange 86 proximate a terminal receiving end 88, and spaced therefrom towards a mating side 90, is a radial flange 92 and further spaced therefrom towards the mating side 90 is a cylindrical seal mounting surface 94 for receiving an elastomeric seal 96 (FIG. 25). The shroud 82 comprises locking ring mounting latches 98 spaced therearound. Within the shroud 82, are keying projections 100 extending from the mating face 90 longitudinally along the inside of the shroud 82.

Figure 16:
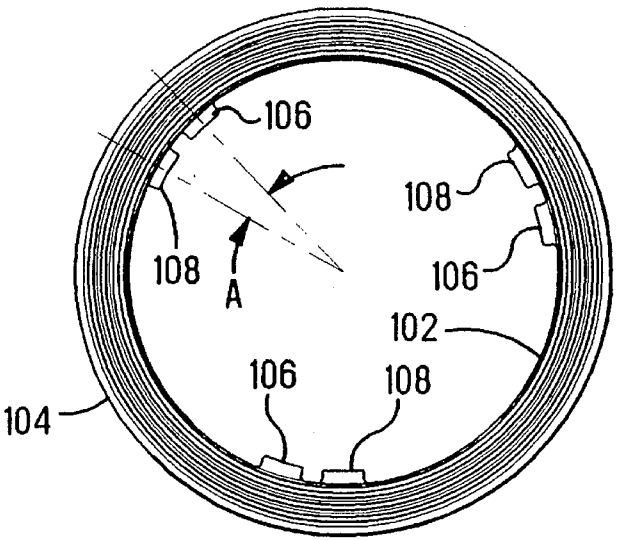
FIG. 16 is a provisional mounting and sealing ring.

With reference to FIG. 16, the sealing and provisional mounting ring 10 will be described in detail (see also FIG. 1). The ring 10 comprises an inner ridged mounting ring 102 and mounted thereon an outer elastomeric sealing ring 104. The mounting ring 102 comprises a plurality of equally spaced apart tabs 106 projecting radially inwards on one side of the mounting ring 102 and another set of similar tabs 108 attached to the other side of the mounting ring whereby the tabs 106 are offset rotationally by a small angle A to the tabs 108.

Figure 17:
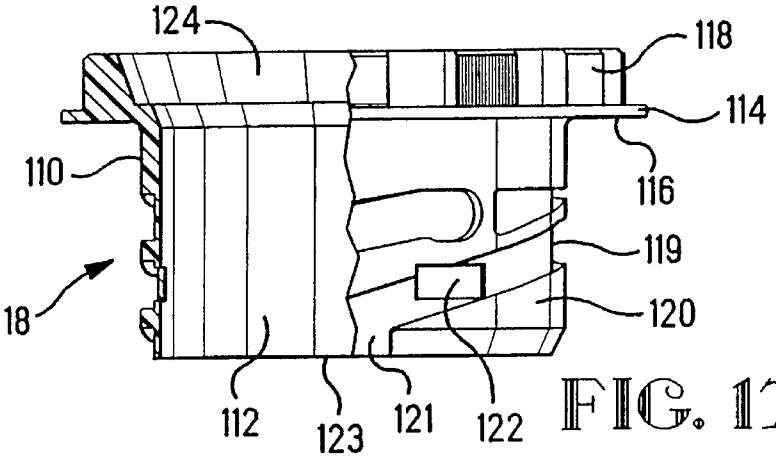
FIGS. 17 and 18 are respectively part cross sectional and top views of a locking ring mountable to the component of FIGS. 13 to 15.
Figure 18:
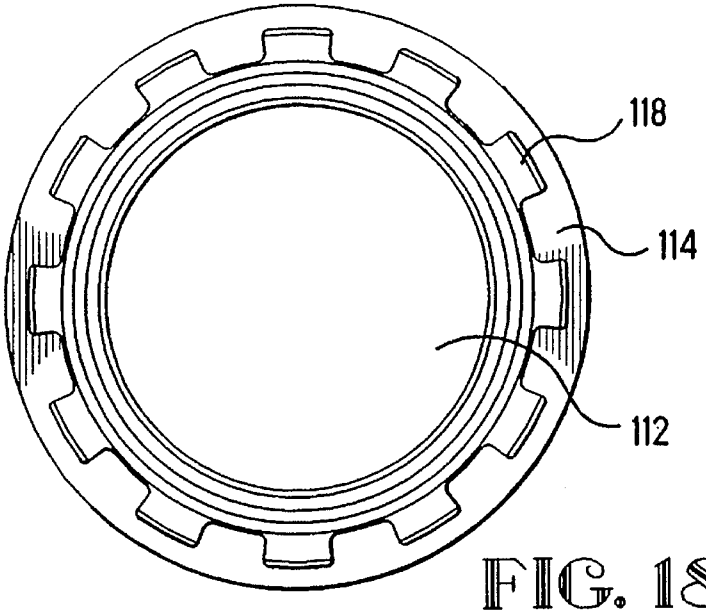
Figure 21:
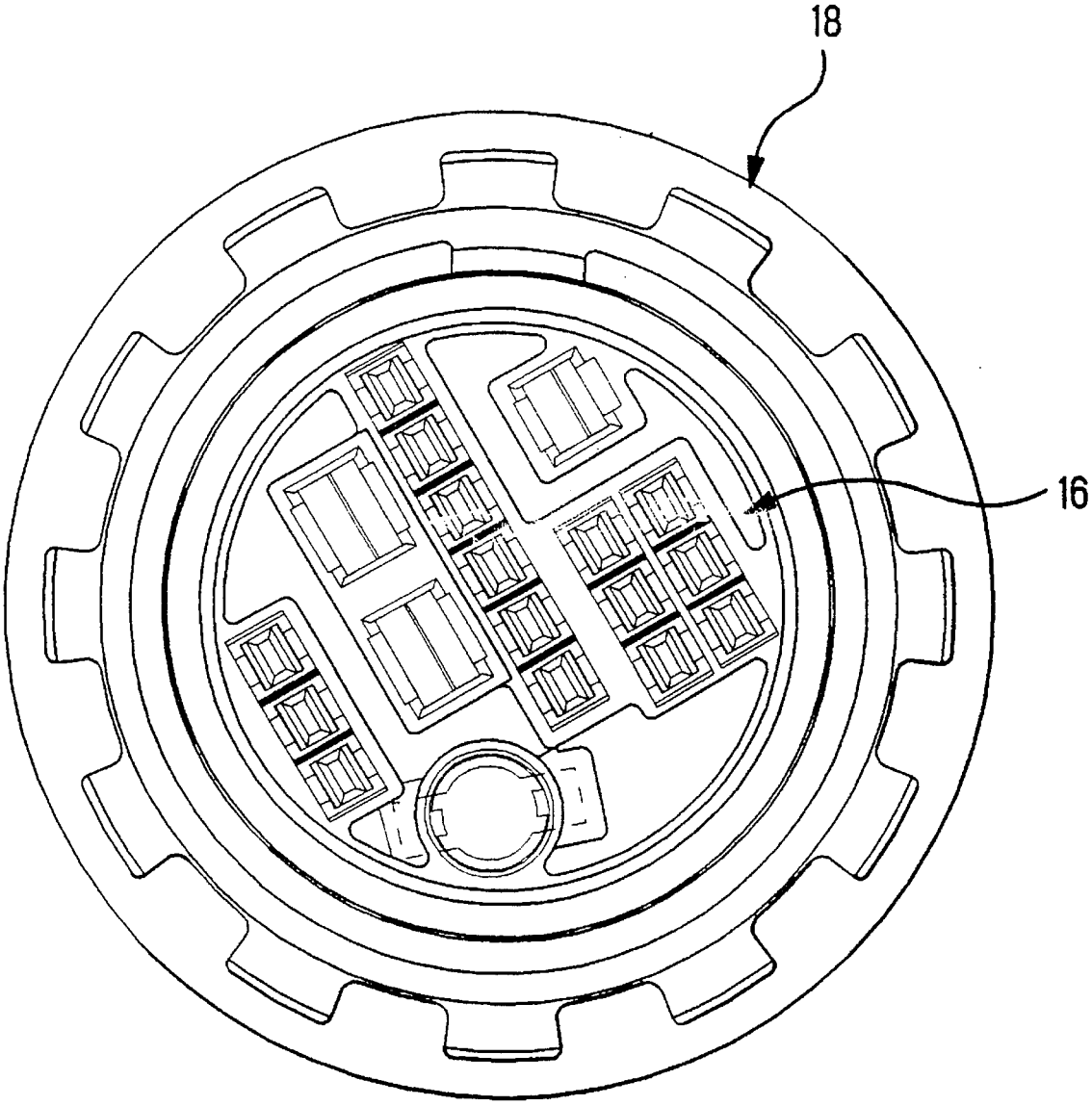
FIG. 21 is a view of the mating face of the movable component with locking ring.

With reference to FIGS. 17 and 18, the locking ring will now be described in detail. The locking ring 18 comprises a housing 110 having a cylindrical cavity 112 therethrough substantially closely mountable over the shroud 82 of the movable connector housing 16, a radially outwardly extending flange 114 having a forwards sealing surface 116 pressable against the seal 104, and adjacent the flange 114 on the other side to the sealing face 116 is a crowned ring shroud 118 for receiving a tool for rotating the locking ring 18. Extending from the flange 114 and surrounding the cavity 112 is a thin walled ring portion 120 comprising a plurality of spiraling grooves 119 (bayonet type) for receiving the cylindrical studs 40 (FIG. 3) of the panel mount connector 12, each groove 119 having a stud entry passage 121 at a forward end thereof. The ring portion 120 also comprises a plurality of rectangular cavities 122 therearound for receiving the latches 98 (FIG. 13) of the movable housing components 16, and a forward edge 123 also engageable with the latches 98. Extending from the cavity 112 and radially below the crowned ring 118 is a conical cavity section 124.

Figure 19:
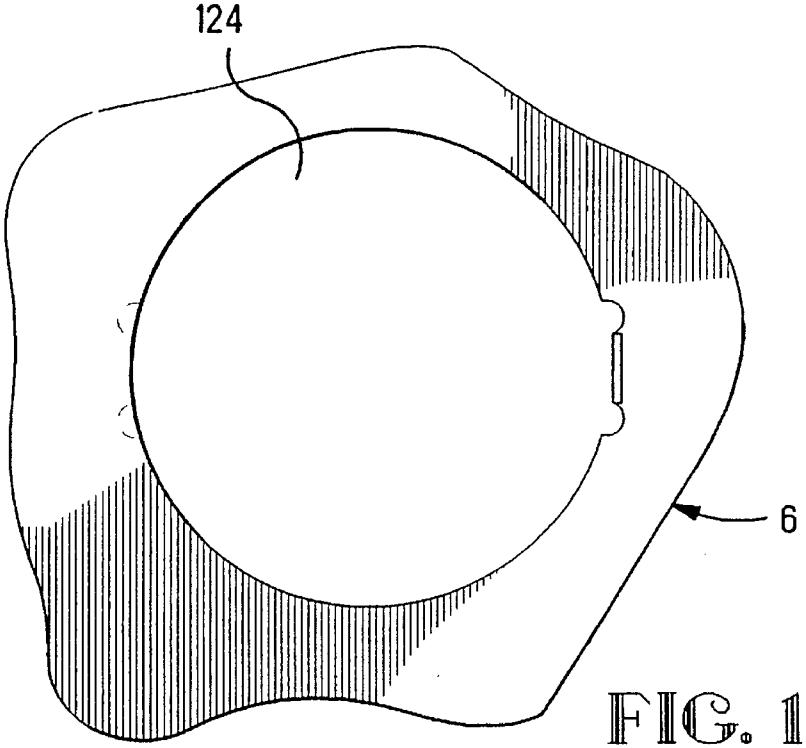
FIGS. 19 and 20 are respectively plan and cross sectional views of a sheet metal panel to which the connector is mounted.
Figure 20:
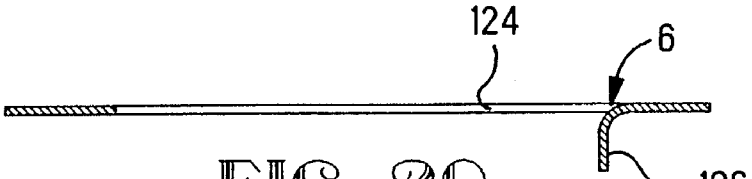

With reference to FIGS. 19 and 20, the panel 6 is shown comprising a cutout 124 for receiving the panel mount connector housing 12, and bent perpendicularly therefrom, a tab 126 projecting towards the panel housing 12 and engageable in the gap 31 (FIG. 3) thereof.

Figure 24:
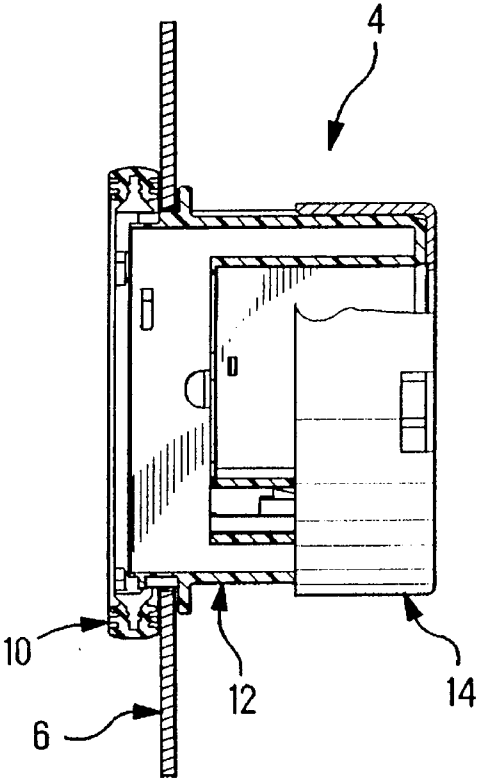
FIGS. 22 to 24 show mounting of the panel components to the panel.
Figure 23:
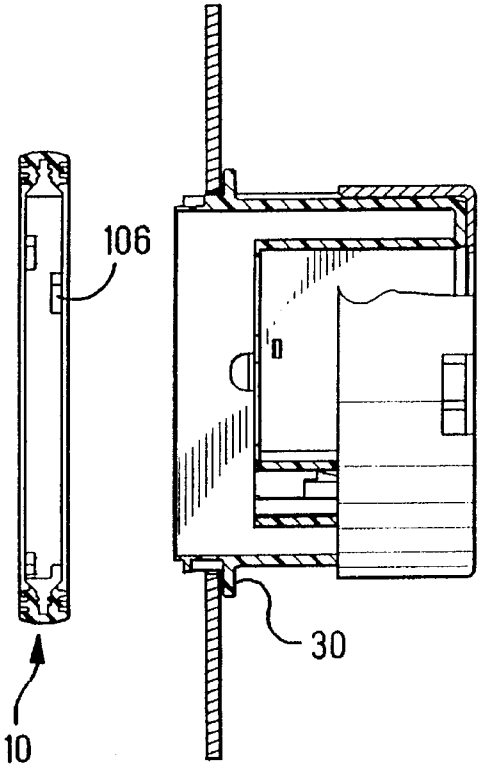
Figure 22:
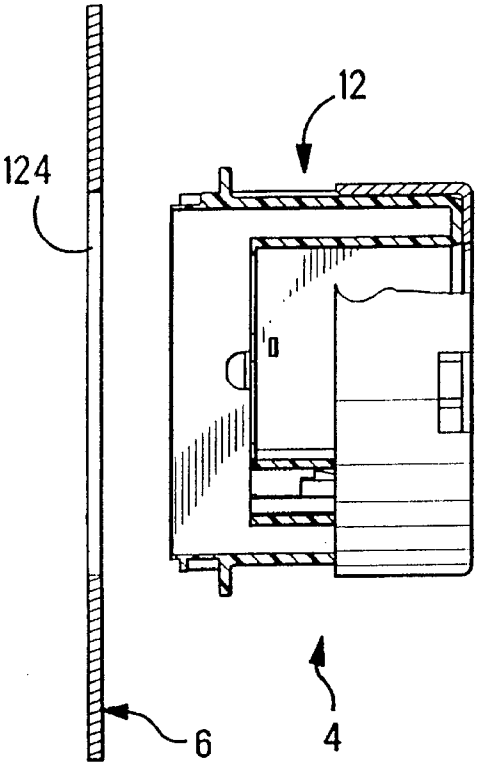

With reference to FIGS. 22 to 24, assembly of the panel mount component 4 to the panel 6 will now be explained. The panel mount component 4 comprises, prior to assembly to the panel 6, terminals mounted in the terminal modules 70 fully assembled to the housing 12 and locked therein with the end cap 14, whereby the terminals are connected to electrical conducting cables, optical cables or pneumatic pipes (not shown for simplicity). The assembled panel mount component 4 can then be assembled to the panel 6 by aligning it with the panel hole 124 whereby the panel tab 126 (FIG. 20) is aligned with the flange gap 31 (FIG. 3) of the housing 12. The latter not only serves to correctly position and prevent rotation of the panel component 4 relative to the panel 6, but also ensures that the terminal modules are securely locked into the housing 12 due to the end cap tab 66 that overlaps and blocks entry through the gap 31 when the end cap is not rotated into the locked position (FIG. 11). As shown in FIG. 12, when the end cap is fully rotated and the terminal modules locked within the housing 12, the end cap tab 66 unblocks the gap 31.

Once the housing 12 is inserted through the hole 124 such that the housing flange 30 abuts thereagainst, the mounting and sealing ring 10 can then be assembled thereto by aligning the tabs 106 thereof with the gaps 38 at the entry of the spiral grooves 36 of the housing 12 (FIG. 5), and then inserting the tabs thereinto and rotating the ring 10 such that the tabs 106 travel along their corresponding grooves 36. Whilst the tabs 106 travel along the grooves 36, the other set of tabs 108 on the other side of the mounting ring 102 remain outside of the grooves 36 along the outer edge 37. When the ring 10 is fully rotated, the tabs 106 abut the end wall 39 of the grooves 36 whereby the tabs 106 and 108 are angularly misaligned such that the tabs 108 become aligned with the gaps 38. In the latter position as the tabs 106 are within the grooves 36, the ring 10 provisionally holds the panel mount component to the panel 6. The purpose of the tabs 108 aligned with the grooves 38 in the fully rotated position, is to allow axial movement of the ring 10 towards the panel 6, whereby during this axial movement the tabs 108 enter into the gaps 38 such that the tabs 108 prevent the ring 10 from rotating open by abutting the end wall 39 on the other side thereof than the tabs 106. The purpose of the latter, is to stop rotation of the ring 10 during disconnection of the movable connector 8 in order to ensure that the ring 10 continues to hold the panel mount component 4 to the panel 6 during this operation. The further purpose of allowing axial movement of the ring 10 is to enable axial movement thereof during compression of the seal 104 when the connector parts 8 and 4 are mated together. If the tabs 108 did not engage in the gap 38 when fully rotated to the housing 12, rotation of the locking ring 18 during unmating of the connector part 8 from the connector part 4 might cause the ring 10 to rotate also due to the frictional forces, such that the tabs 106 travel back along the grooves 36 and out of the gaps 38. This in turn would probably cause the housing 12 to fall away from the panel 6 which is obviously undesirable. As the tabs sets 106 and 108 are identical, the sealing ring 10 can be mounted from either side thereof, which is advantageous as it eliminates the possibility of error and the need to orientate the ring 10 during assembly.

Figure 27:
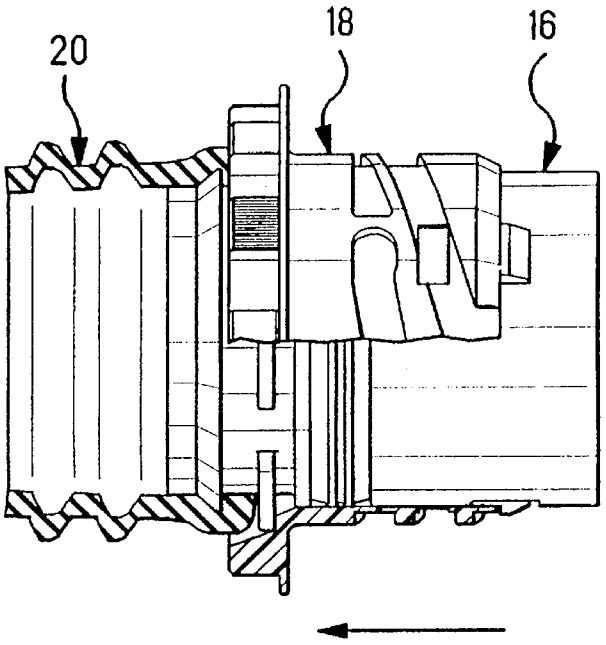
FIGS. 25 to 27 show assembly of the rubber boot to the movable component.
Figure 26:
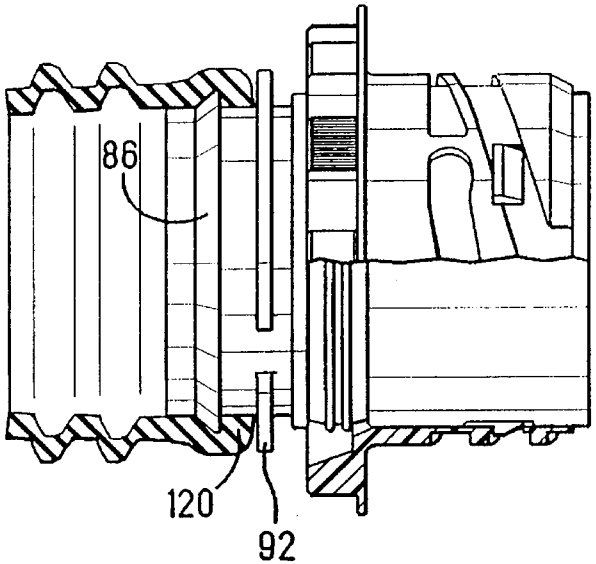

Referring to FIGS. 25 to 27, the assembly of the moveable components 8 will now be described. The locking ring 18 is first mounted to the housing 16 by sliding it over the shroud 82 thereof until the latches 98 engage in the windows 122 of the locking ring. The latter defines a preassembled position whereby the cooperation of the latches 98 and windows 122 provisionally hold the locking ring 18 to the housing 16 yet allow assembly of terminals into the receiving cavities 84 prior to mounting of the rubber boot 20. In the provisional position, the moveable connector 8 can not be mated with the panel mount connector 4 because the locking ring 18 can not rotate relative to the housing 16. Terminals (not shown) can then be mounted and securely locked into the terminal receiving cavities 84, whereby around the terminals is loosely positioned the rubber boot 20 which is then pulled over the rubber boot mounting flange 86. The tapered leading edge of the mounting flange 86 facilitates pulling of a forwards mounting portion 120 of the rubber boot thereover by elastic deformation thereof. The mounting portion 120 then seats itself behind a shoulder of the flange 86. The rubber boot is also stopped from sliding further forwards by the flange 92. In the position as shown in FIG. 26, the rubber boot can be removed from around the flange 86 by exerting sufficient force, either accidentally during handling thereof, or purposefully if access is required to the terminals. In order to secure the rubber boot to the connector housing 18, the locking ring 18 is pulled towards the rubber boot such that the housing latches 98 are resiliently biased inwards as the locking ring windows 122 slide therepast, whereby the latches 98 then engage and abut the forward edge 123 of the locking ring to secure the locking ring in the most rearward position. Simultaneously to the latter, the inner conical surface 124 of the crowned ring 118 is inserted partially over the mounting portion 120 of the rubber boot. In this position the rubber boot 20 can no longer be pulled off the mounting flange 86 of the connector housing 16. As the rubber boot mounting portion 120 is resiliently biased outwards, it abuts the conical surface 124 and prevents further resilient biasing outwards thereof thus remaining captured behind the shoulder of the flange 86. The flange 92 of the housing 16 prevents further rearward sliding of the locking ring 18 which is however free to rotate. The elastomeric seal 96 is compressed between the cylindrical inner surface of the locking ring and the cylindrical seal mounting surface 94 of the housing 16 for sealing therebetween.

Figure 29:
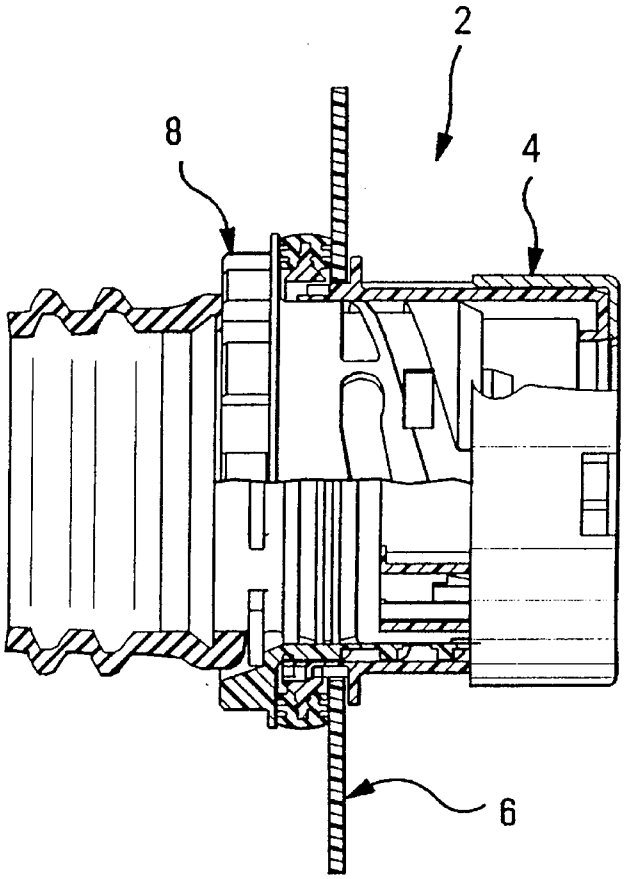
FIGS. 28 and 29 show mating of the movable component to the panel component.
Figure 28:
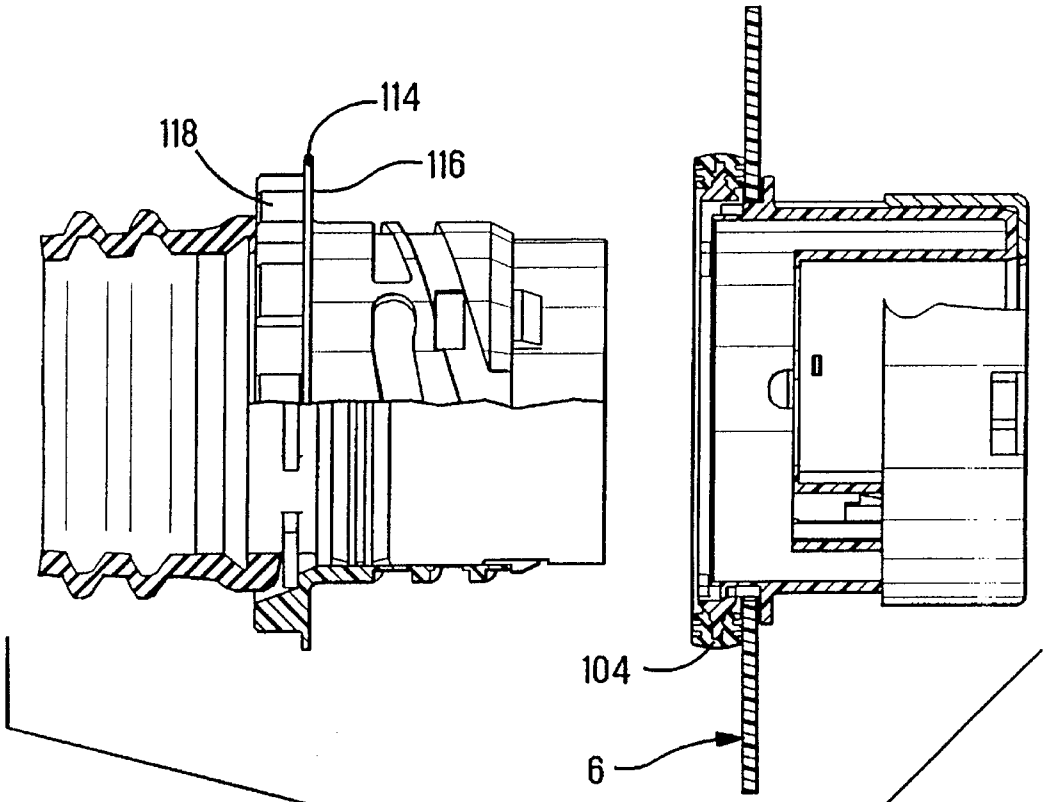

Referring to FIGS. 28 and 29, mating of the connector parts 8 and 4 will now be described. The movable connector part 8 is rotatably orientated until the keying projections 100 align with the keying slots 41 of the panel mount housing 12, whereby the movable housing 16 can then be partially inserted into the housing 12 until the forward end 123 of the locking ring 18 abuts the panel housing studs 40. The locking ring can then be freely rotated until the studs 40 engage into the bayonet type spirals 119, 121 of the locking ring which is then rotated by hand or using a tool engaging the serrations of the crowned ring shroud 118 thereby approaching the connector parts 8 and 4 until the studs 40 abut with the end of the spirals 119. Simultaneously to the latter, the sealing surface 116 of the locking ring flange 114 compresses the sealing ring 104 against the panel 6 thereby sealing therebetween. Also simultaneously to the latter, is the mating of the terminals of the movable connector 8 to the panel connector 4. The connector parts 8 and 4 are thus fully mated together and the movable connector side 8 sealed off from the panel mount connector side 4. In order to disconnect the connectors 8 and 4, it suffices to rotate the locking ring in the opposing directions by hand or by using a tool engaged in the crown ring 118 whereby the sealing and mounting ring 10 is prevented from rotating open due to engagement of the tabs 108 against the shoulder 39 as already explained hereinabove. The latter therefore prevents the panel mount connector 4 from falling off of the panel 6 when unmating the components 8 and 4.

Advantageously therefore, the panel mount connector 4 can be easily and rapidly mounted and dismounted to the panel 6 by use of the sealing and provisional mounting means 10. The panel mount connector 4 is also advantageous in that terminals are first mounted into distinct modules 70 which can then be rapidly inserted into corresponding cavities 22 of the panel connector housing 12; and then securely retained therein by mere rotation of the end cap whereby the end cap has tab means 66 which prevent mounting of the panel connector 4 to the panel 6 if the terminal modules are not securely locked therein. The use of terminal modules 70 allows cable harnesses stemming from different locations to be mounted into the panel mount connector 4, which reduces the number of harnesses and holes that would have to made into the panel 6 as opposed to each terminal module 70 fed and mated individually. If other terminal module types are used, or a modification required, a new panel mount connector 4 can be produced without changing exterior dimensions and thus remain mountable to the same panel hole 124. This is an important aspect especially in the automobile industry where changing, or adding a panel hole 124 requires modification to the stamping and forming die which is very costly. Advantages of the movable connector part, is the retractable locking ring 18 in order to protect the rubber boot from being pulled off. A further advantage is also the shroud 82 which entirely surrounds and protect the terminals that project from the mating face 90 of the movable connector housing 16.

We claim:

1. A panel mount connector assembly comprising a first connector part mountable to a panel and a second connector part matable to the first part for connection therebetween, characterized in that the assembly comprises a sealing ring rotatably mountable to the first connector part from one side of the panel when the first connector part is inserted through a hole in the panel from the other side thereof, whereby the sealing ring is rotatably mountable to the connector part from either side of the sealing ring, provisionally holds the first connector part to the panel prior to mating with the second connector part, and acts as a seal between the one side and the other side of the panel when the first and second connector parts are mated together.

2. The assembly of claim 1 characterized in that the second connector part comprises a housing for receiving terminals and a rotatable locking ring for securing the second to the first connector part, the housing comprising rubber boot fixing means around the periphery of the housing proximate a terminal receiving end thereof, and the locking ring comprising a shroud whereby the locking ring is slidable from a first position away from the rubber boot fixing means to a second position proximate the means such that the shroud extends at least partially thereover for preventing removal of a rubber boot therefrom.

3. The assembly of claim 1 characterized in that the sealing ring has tabs extending radially inwards, the tabs engageable in bayonet-type slots of the first connector part.

4. The assembly of claim 3 characterized in that the tabs are disposed in two lateral sets, one set proximate one side of the sealing ring and the other set proximate the other side thereof, whereby the connector housing slots have windows for receiving one set of tabs and whereby the ring is rotatable until the other second set of tabs are adjacent the windows and axially movable towards the connector housing such that the second set of tabs engage in the windows for preventing rotation of the ring relative to the housing.

5. The assembly of any preceding claim characterized in that the first connector part comprises an end cap receivable over a terminal receiving end thereof, the cap having terminal receiving holes aligned and corresponding to terminal receiving cavities of the connector housing, the end cap being movable relative to the housing from a first position to a second position and visa-versa, whereby in the first position terminals are insertable into the housing cavities, and in the second position the inserted terminals are locked within the housing.

6. The assembly of claim 5 characterized in that the first connector housing comprises a panel mounting flange having means for polarizing the connector with respect to the panel, and the end cap comprises means proximate the polarizing means such that in the first position the first connector part cannot be mounted to the panel.

7. The assembly of claim 6 characterized in that the polarizing means comprises a cut-out in the flange for receiving a bent tab of the panel.

8. The assembly of claim 2 characterized in that keying means extend from a mating face of the second connector part such that it cannot be assembled to the first connector part unless the locking ring is retracted to the second position allowing it to rotate relative to the housing.

* * * * *